US005577647A

United States Patent [19]

Pittarelli et al.

[11] Patent Number: 5,577,647

[45] Date of Patent: Nov. 26, 1996

[54] BOTTLE CARRYING DEVICE

[76] Inventors: Diana Pittarelli, 16406 Briar Patch Pl., Miami Lakes, Fla. 33014; Michael J. Langieri, Jr., 425 Inverness La., Longmeadow, Mass. 01106

[21] Appl. No.: 474,066

[22] Filed: Jun. 7, 1995

[51] Int. Cl.[6] ..... A45F 5/00

[52] U.S. Cl. ..... 224/148.6; 224/148.1; 224/603; 224/257; 215/228; 215/387

[58] Field of Search ..... 224/148.1, 148.2, 224/148.3, 148.4, 148.5, 148.6, 600, 601, 603, 607, 257, 258, 202 F, 148 F; 215/228, 306, 217, 311, 387, 389; 220/212.5, 375, 751; D3/229; D17/601, 619, 620; D9/434, 446; 222/175

[56] References Cited

U.S. PATENT DOCUMENTS

| | | | |
|---|---|---|---|
| D. 286,859 | 11/1986 | Wu . | |
| D. 346,532 | 5/1994 | Ogden et al. . | |
| 3,830,270 | 8/1974 | Hagert et al. | 224/148.5 |
| 4,733,807 | 3/1988 | Porter et al. . | |
| 5,145,094 | 9/1992 | Perlmutter | 215/311 |
| 5,147,079 | 9/1992 | Heather . | |
| 5,167,354 | 12/1992 | Cohanfard . | |
| 5,183,183 | 2/1993 | Hernandez . | |
| 5,409,151 | 4/1995 | Freimark | 224/148.6 |

FOREIGN PATENT DOCUMENTS

| | | | |
|---|---|---|---|
| 121328 | 5/1946 | Australia | 224/148 |
| 143788 | 1/1954 | Sweden | 224/148 |

*Primary Examiner*—Henry J. Recla
*Assistant Examiner*—Gregory M. Vidovich
*Attorney, Agent, or Firm*—Christensen O'Connor Johnson & Kindness PLLC

[57] ABSTRACT

A bottle carrying device (20) for carrying a conventional bottle (24) from a flexible extension member (22), includes a main body portion (30). A substantially cylindrical recess is formed in a first end of the main body portion, which has internal threads (34) formed therein. The internal threads threadably receiving an externally threaded end (26) of the bottle. A second end of the main body portion (30) includes a passage (38) formed therein, which connects in fluid communication with the recess. A squeeze spout (36) connects to the second end of the main body portion, and connects in fluid communication with the passage. The squeeze spout includes a cap (40), which is slidable from a first position to a second position, wherein a path of fluid communication is opened through the squeeze spout when the cap is in the first position, and the path of fluid communication is closed when the cap is in the second position. A wing portion (46) having an aperture (48) formed therethrough, connects to the wing portion for receiving the flexible extension member.

5 Claims, 4 Drawing Sheets

BOTTLE CARRYING DEVICE

FIELD OF THE INVENTION

The present invention relates to carrying devices and, more particularly, to carrying devices for bottles.

BACKGROUND OF THE INVENTION

People often become thirsty and/or dehydrated when exercising or engaging in other physical activities. Thus, many people frequently place a bottle of water or other liquid refreshment at a nearby location when engaging in physical activity to satisfy their thirst, and/or for rehydration.

However, there are at least two principal problems with this. First, often the bottle is misplaced. Second, many types of physical activities, such as hiking, horseback riding, skiing, walking, etc., are not suited to placing a bottle at a nearby location because the person travels over a relatively large area when engaging in the physical activity.

An attempted solution to the foregoing problems has been for people to carry the bottle with them. As many people desire to have their hands free, often a carrying device is provided for the bottle. Typically, the carrying device includes a sling or harness suspended from a strap or cord, which extends around a person's neck, or neck and shoulder. Thus, the bottle is carded suspended in the sling or harness. However, these types of sling or harness arrangements are disadvantageous in that they increase the weight the person must carry, and are expensive.

Additionally, many people prefer to carry disposable bottles of spring, distilled, or mineral water. Hence, when the bottle is empty of liquid, the bottle is discarded, and another, full bottle is purchased, rather than refilling the bottle with ordinary tap water. Many of the sling or harness type arrangements make it inconvenient to remove and discard a bottle when it is empty.

Accordingly, the present invention provides an improved solution to the foregoing problems.

SUMMARY OF THE INVENTION

The invention provides a bottle carrying device for carrying a conventional bottle from a flexible extension member. A preferred embodiment of the device includes a main body portion having a substantially cylindrical recess formed in a first end. The recess includes internal threads for threadably receiving an externally threaded end of the bottle. A second end of the main body portion includes a passage connected in fluid communication with the recess. A squeeze spout attaches to the second end of the main body portion, and connects in fluid communication with the passage.

The squeeze spout includes a cap which is slidable from a first position to a second position, wherein a path of fluid communication is opened through the squeeze spout when the cap is in the first position, and the path of fluid communication is closed when the cap is in the second position.

In a preferred embodiment, a pair of wing portions radially extend from opposite sides of the main body portion. Each wing portion includes an aperture formed therethrough for receiving the flexible extension member. Preferably, the aperture in each wing portion is in the form of a slot having a longitudinal axis oriented generally parallel to the longitudinal axis of the bottle when the main body portion is threadably connected to the bottle.

In other aspects, each wing portion includes a channel extending from the aperture to the exterior of the wing portion. The flexible extension member is slidable through the channel to the aperture for quick, convenient connection of the extension member to the wing portion.

In an alternate embodiment, the bottle carrying device includes first and second collar halves for connecting to the neck of a conventional bottle, rather than threading to the end of the bottle. An aperture is formed through the end of each of the collar halves for receiving the flexible extension member. Preferably, the aperture is a slot having a longitudinal axis generally diagonal to the central axis of the bottle, when the device is connected to the neck of the bottle.

A hinge connects between the first ends of the collar halves. Preferably, the hinge is formed integral with first end of each of the collar halves. The first and second collar halves are thus pivotable about the hinge to a closed position with the second end of each of the collar halves contacting one another, and to an open position with the second end of each of the collar halves remote from one another. When the collar halves are in the closed position, a circular opening is formed by the first and second collar halves for snugly receiving the neck of the bottle.

The second end of one of the collar halves includes a hook, and the second end of the other collar half includes a hook receiving opening. In the closed position, the hook is received in the opening and fastens thereto for releasably fastening the second end of each of the collar halves to one another.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
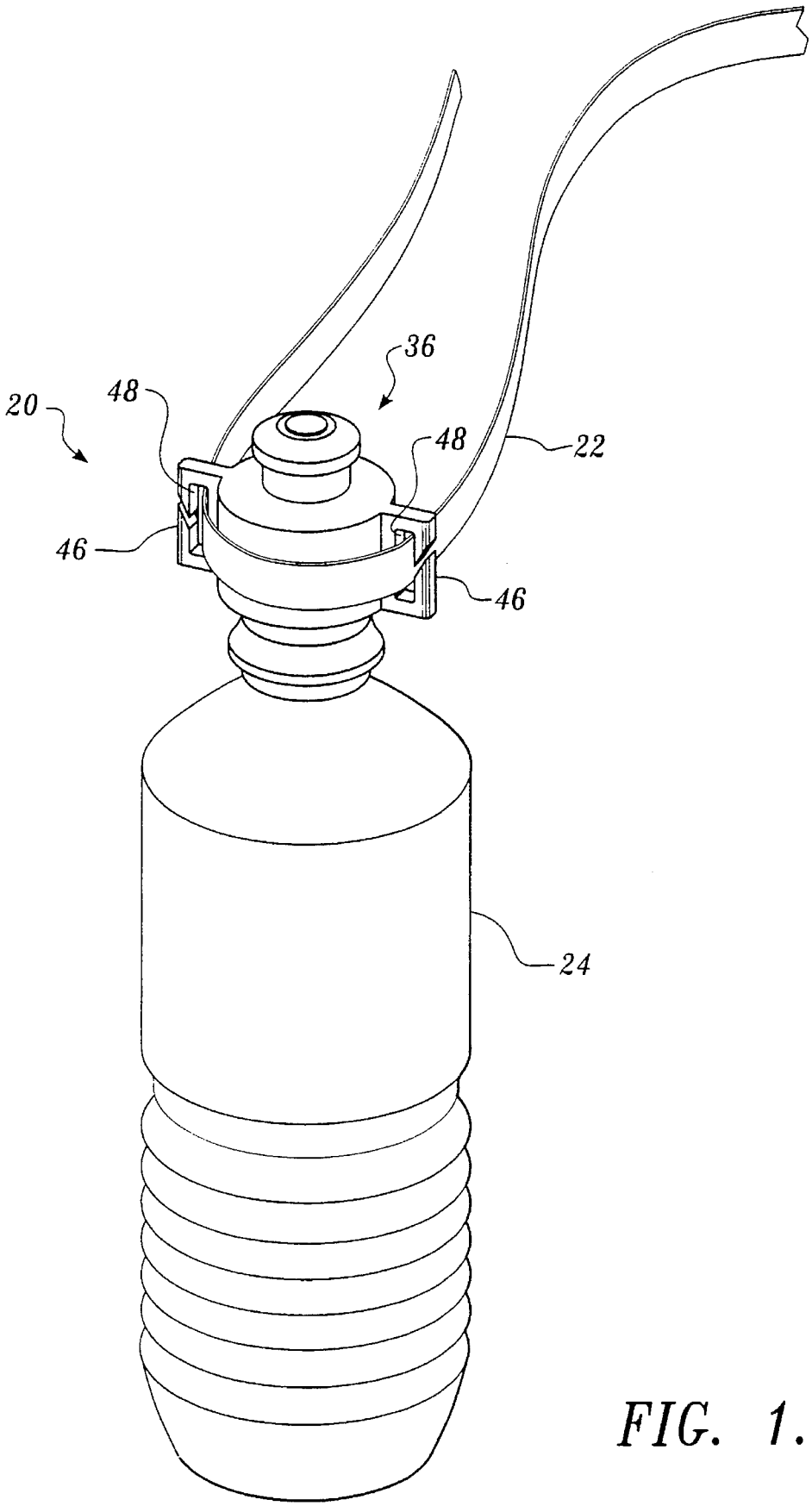
FIG. 1 is a perspective view of a preferred embodiment of a bottle carrying device in accordance with the present invention shown connected to a bottle and to a strap.

A preferred embodiment of a bottle carrying device in accordance with the present invention, indicated generally by reference numeral 20, is illustrated in FIG. 1. The bottle carrying device 20 is shown connected to a flexible extension member, or strap 22, and to a bottle 24. Bottle 24 is of a conventional plastic type, commonly sold containing different types of water, such as spring, distilled, or mineral water. The strap 22 is also of conventional type, typically formed from strands of a woven nylon material.

Figure 2:
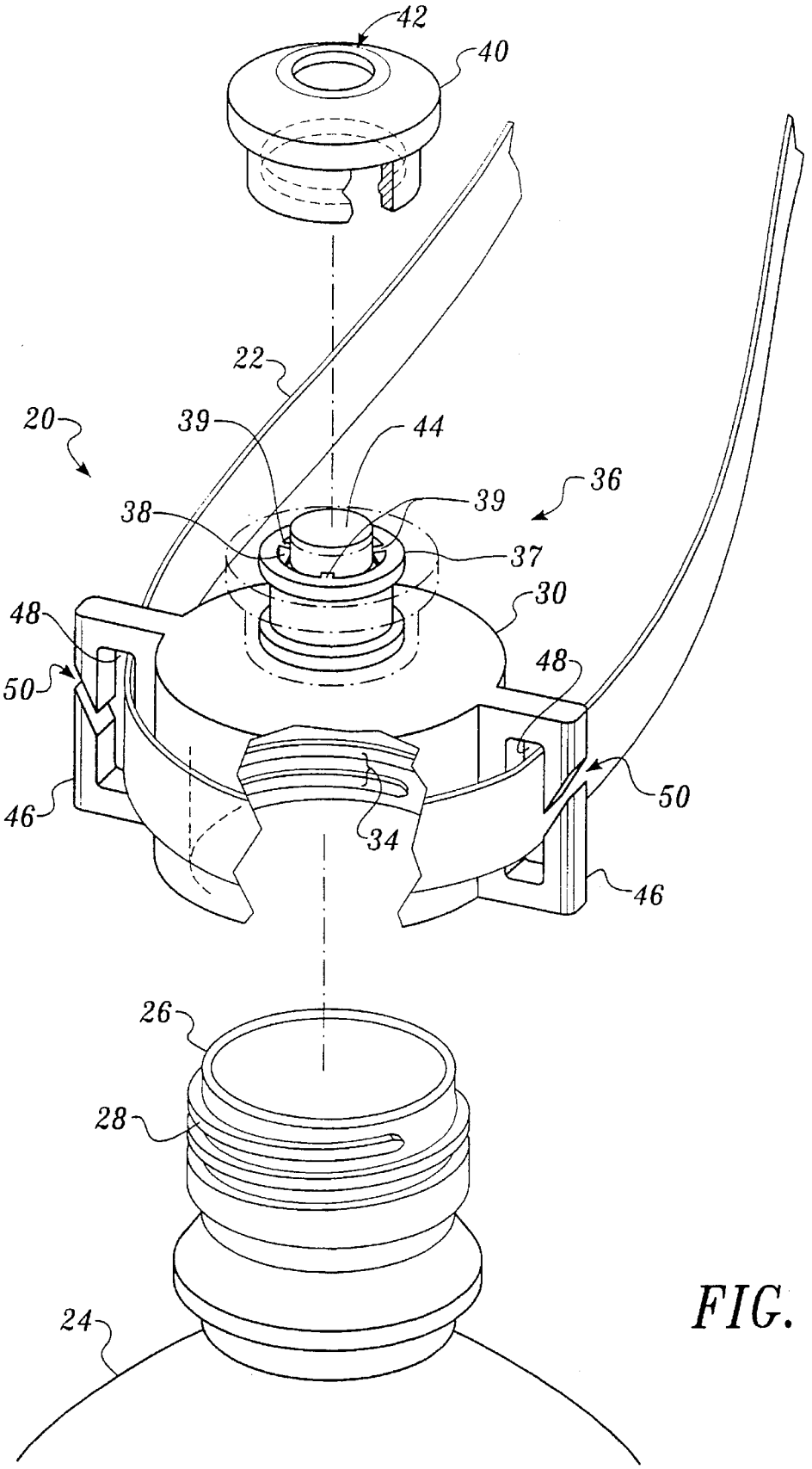
FIG. 2 is an enlarged, partially exploded perspective view of the bottle carrying device of FIG. 1 shown with part of the bottle carrying device cut away, and disconnected from the bottle.

FIG. 2 is an enlarged, partially exploded view of the bottle carrying device 20, shown disconnected from the bottle 24, with pan of the bottle carrying device cut away. The bottle 24 includes an outlet nipple 26 having threads 28 formed externally thereon. When the bottle 24 is initially purchased from a vendor, a cap 27 (see FIG. 4) having internal threads is normally threadably engaged with the nipple 26 of the bottle, to retain the contents of the bottle therein. When the bottle carrying device 20 in accordance with the present invention is used, the cap 27 is removed from the bottle 24 and replaced with the bottle carrying device. Alternatively, a bottle 24 could be supplied with the bottle carrying device 20.

As indicated in FIG. 2, the bottle carrying device 20 includes a generally cylindrically shaped main body portion 30. The main body portion 30 is substantially cylindrical and has internal threads 34, formed more or less concentrically in the end of the main body portion that attaches to the bottle 24. The internal threads 34 are sized to threadably secure to the externally threaded nipple 26 of the bottle 24.

An outlet spout 36 is connected approximately to the center of the opposite end of the main body portion 30. The outlet spout 36 is of standard type, for example, of the kind frequently used to squeezably dispense liquid dish-washing soap. The outlet spout 36 includes a hollow spool-shaped member 37 more or less coaxially connected to the upper end of the main body portion 30. A generally circular passage 38, defined approximately through the center of spool-shaped member 37, connects in fluid communication to the interior of the main body portion 30.

A substantially cylindrical plug 44, is positioned approximately in the center of the passage 38 in the spool-shaped member 37 by three centering struts 39. The struts 39 extend from generally evenly spaced locations around the inside circumference of the passage 38, to the post 44, and retain the post 44 so that it extends substantially coaxially out of the end of the passage. The plug 44 has a diameter slightly less than the diameter of the passage 38, such that a path of fluid communication exists between the plug 44 and the struts 39 to the interior of the main body portion 30.

The outlet spout 36 includes a hollow, generally mushroom-shaped cap 40, shown exploded away from spout 36 for clarity. An aperture 42 is formed in the upper surface of the cap 40 leading to the cap's hollow interior. The aperture 42 has a diameter less than or equal to the diameter of the plug 44. The cap 40 connects to the spool-shaped member 37 as indicated by the phantom position of the cap in FIG. 2, and generally coaxially surrounds the spool-shaped member and the plug 44. When the cap 40 is connected to the spool-shaped member 37, the cap 40 is axially slidable along the spool-shaped member from a first open position to a second closed position.

In the first position, the cap 40 is extended along spool-shaped member 37, away from the main body portion 30. In this first position a path of fluid communication exists through the aperture 42 in the cap 40, between the struts 39 and the plug 44 to the interior of the main body portion 30. In the second position, the cap 40 is retracted downwardly against the main body portion 30, wherein the aperture 42 is obstructed by the plug 44, which substantially closes the path of fluid communication through the outlet spout 36.

A pair of wings 46 extend radially outwardly from substantially diametric opposite sides of the main body portion 30. Each wing 46 includes an aperture 48 formed therethrough. The slot 48 is sized to receive the strap 22, as shown in FIG. 1. In an alternate embodiments, the bottle carrying device 20 may include only one wing 46 for receiving the strap 22, or more than two wings. Preferably, the wings 46 are formed integrally with the main body portion 30.

In the preferred embodiment of the device 20, the wings 46 are generally rectangularly shaped, having a generally rectangularly shaped aperture slot formed therein. Preferably, each wing has a longitudinal exterior margin extending generally parallel to the central axis of the bottle 24, when the bottle carrying device 20 is threadably secured to the bottle. The exterior margin defines the exterior longitudinal side of a slot. The slots 48 are sized and shaped to receive a strap that is generally rectangular in cross-section. Hence, a single strap 22 can be extended through each of the wings 46, with the width of the strap facing the side of the main body portion 30, as shown in FIG. 1.

In other embodiments, the wings 46 and slots 48 may have other orientations and geometries. For example, the wings 46 may be oriented such that the longitudinal margins of the wings are generally perpendicular to the central axis of the bottle 24, when the bottle carrying device 20 is threadably connected to the bottle. In this configuration, preferably one end of a strap 22 is connected to one wing member 46, while the opposite end of the strap is connected to the other wing member. This permits the bottle to be suspended from the strap 22 such that the central axis of the bottle 24 is maintained substantially vertical.

In a further embodiment, a bottle carrying device in accordance with the present invention can be used with a string or cord of round cross-section in place of a strap 22. If a string or cord is used, the slots 48 preferably are circular in shape to correspond to the circular cross-section of a string or cord. The wings also may be of circular shape. The wings 46 and the slots 48 could also have other geometries, such as elliptical, oval, triangular, or square shapes, by way of non-limiting illustrative examples.

In the preferred embodiment, an entrance channel 50 is formed in each of the wings 46, as indicated in FIG. 2. The channels 50 are preferably formed through the longitudinal exterior side margins of each wing 46. The entrance channels 50 extend through the longitudinal exterior margins of the wings into the slot 48 formed through the wing. The channels 50 are sized such that the strap 22 can be slid edgewise through the channel and into the slot 48. The channels 50 provide a quick, convenient way for threading the strap 22 into the slots 48. The bottle carrier 20 can also be connected to a string or cord. Thus, the channels 50 are also preferably of a size to slidably pass a string or cord therethrough.

Preferably, the channels 50 are formed through each longitudinal exterior margin of the wings 46 at a diagonal angle, as shown in FIG. 2. This helps to prevent the straps 22 from disengaging from the slots 48 out through the channels 50.

Figure 3:
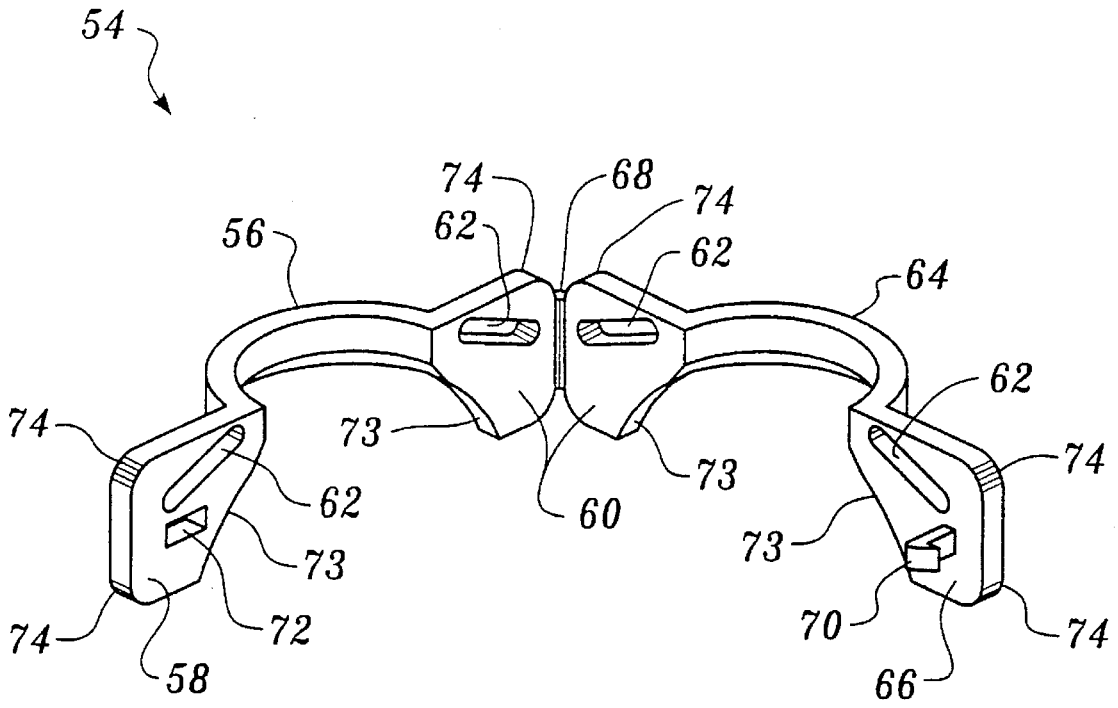
FIG. 3 is a perspective view an alternate preferred embodiment of a bottle carrying device in accordance with the present invention.
Figure 4:
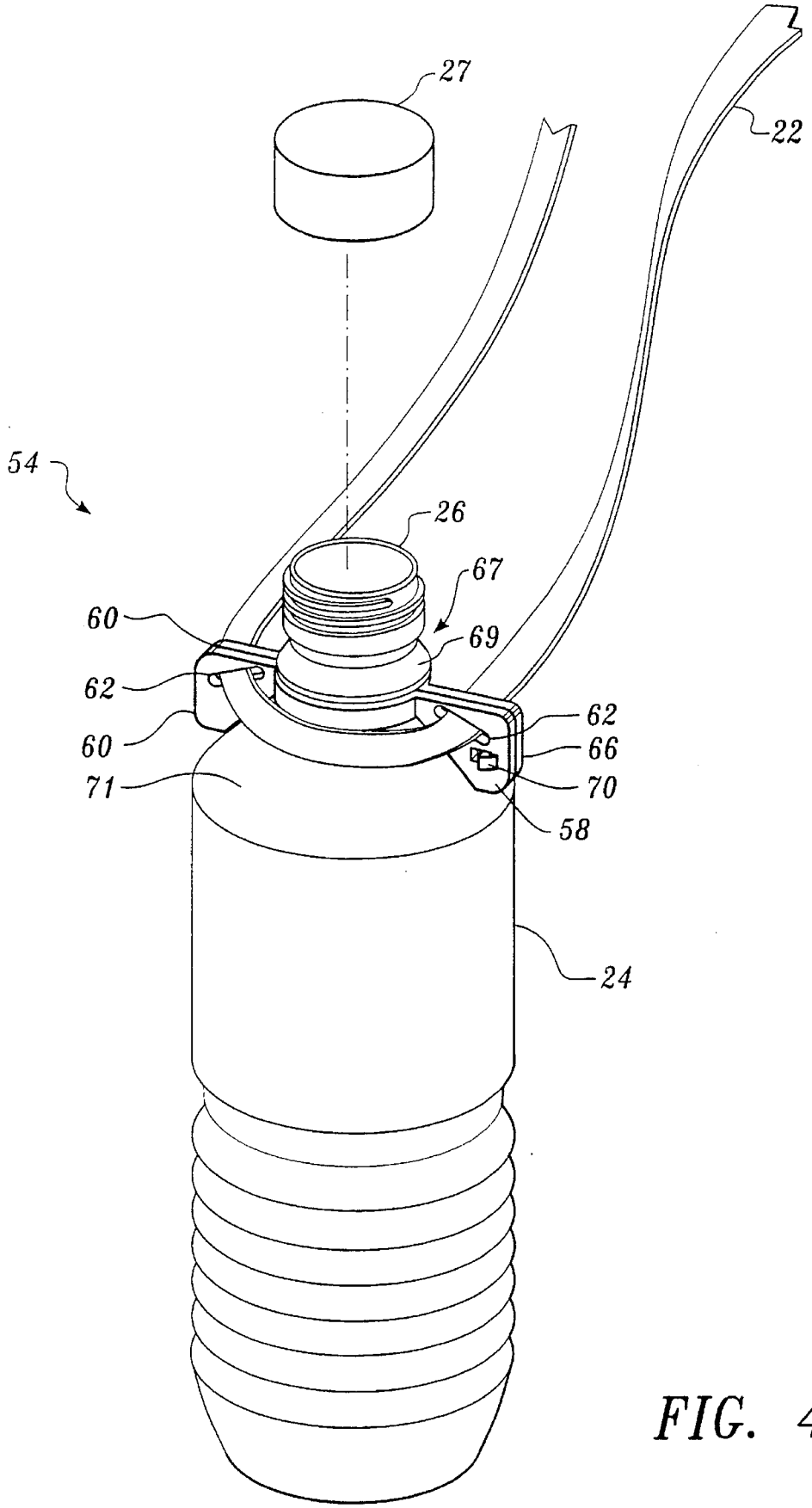
FIG. 4 is a perspective view of the bottle carrying device of FIG. 3 shown connected to a bottle and to a strap.

An alternate embodiment of a bottle carrying device in accordance with the present invention, is indicated generally by reference numeral 54 in FIG. 3. The bottle carrying device 54 includes a first half annular ring section 56, with abutment plates 58 and 60 extending generally diametrically outwardly from each end of ring section 56. Each abutment plate 58 and 60 includes an aperture 62 formed therethrough. Each aperture 62 is formed in the shape of a slot for receiving a flexible extension member or strap 22 as shown in FIG. 4.

Referring to FIG. 3, the bottle carrying device 54 includes a second half annular ring section 64. Ring section 64 includes abutment plates 60 and 66 extending diametrically outwardly from opposite ends of the ring section. The abutment plates 60 and 66 of ting section 64 also each include an aperture (slot) 62 formed therethrough, for receiving a strap 22.

A hinge 68 connects between the abutment plate 60 of ring section 56, and the abutment plate 60 of ring section 64.

Preferably, hinge 68 is of the "living" type formed integrally with the two abutment plates. In the preferred embodiment of bottle carrier 54, the ring sections 56 and 64, and abutment plates 58, 60, and 66 are all formed integrally with one another. In other embodiments, the different components, such as the hinge 68, may be separate parts that are fastened together.

Each ring section 56 and 64 is pivotable relative to one another about the hinge 68 from an open position as shown in FIG. 3, to a closed position as shown in FIG. 4. In the closed position, the abutment plates 58 and 66 abut, or contact one another in face-to-face relationship, as do abutment plates 60 on the opposite side of the bottle carrying device 54. When the abutment plates 58, 60 and 66 contact one another, the slots 62 in the corresponding abutment plates are aligned with each other. Additionally, in the closed position, the ring sections 56 and 64 are in registry with each other so that a generally circular opening is formed by the ring sections.

As shown in FIG. 4, when the bottle carrying device 54 is in the closed position, the neck 67 of a conventional bottle 24 is received in the circular opening formed between the ring sections 56 and 64. The ring sections 56 and 64 are sized, such that the diameter of the circular opening formed therebetween, corresponds approximately to the diameter of the bottle neck 67. Thus, the bottle neck 67 is trapped between the ring sections 56 and 64, when the bottle carrying device 54 is in the closed position.

Moreover, bottle 24 includes a neck band 69 of a diameter larger than the neck 67. Preferably, bottle carrying device 54 is connected to bottle 24, such that the carrying device connects to bottle neck 67 between neck band 69 and the upper shoulder 71 of the bottle. Furthermore, the width of the ring sections 56 and 64 are preferably sized to correspond to the approximate distance between the upper shoulder 71 of bottle 24, and neck band 69, such that the bottle carrying device 54 generally does not axially slide up and down along the neck 67 of the bottle 24.

The abutment plate 66 of ring section 64 includes a hook 70 projecting more or less perpendicularly therefrom. When the bottle carrying device 54 is in the closed position, as shown in FIG. 4, the hook 70 is received in a second aperture 72 formed in the distal abutment plate 58 of the ring section 56. The hook 70 extends through the aperture 72, wherein the hook engages the opposite surface of the abutment plate 58 to releasably lock the bottle carrying device 54 in the closed position. When it is desired to pivot the ring sections 56 and 64 of bottle carrying device 54 to the open position, the hook 70 is flexed to release abutment plate 58, whereupon the hook is withdrawn through aperture 72 as the ring sections are pivoted to the open position.

The lower edges 73 of the abutment plates 58, 60, and 66 are contoured concavely to generally correspond to the contour of the upper shoulder 71 of bottle 24 as shown in FIG. 3. Thus, when bottle carrying device 54 is connected to neck 67 of bottle 24, the lower edges 73 of the abutment plates 58, 60, and 66 generally smoothly contact the upper shoulder 71 of the bottle 24 as illustrated in FIG. 4. Additionally, the outside comers 74 of the abutment plates 58, 60, and 66 are preferably rounded so that the chance of bottle carrying device 54 catching on other objects is reduced.

The longitudinal axes of slots 62 in each of the abutment plates 58, 60, and 66 preferably slope diagonally upwardly relative to outlet nipple 26 of bottle 24, when bottle carrying device 54 is connected to the bottle. This permits strap 22 to be received in slots 62, such that the width of the strap is directed towards the central axis of bottle 24 so that a single loop of strap can be used to carry the bottle 24. In other embodiments, the slots 62 my have other orientations. For example slots 62 may be oriented with the longitudinal axis of each slot generally perpendicular to the central axis of bottle 24, when bottle carrying device 54 is connected to the bottle. In this configuration, preferably one end of a strap 22 is connected to one pair of aligned Mots 62. The opposite end of the strap is connected to the other pair of aligned slots 62. Thus, this permits the bottle to be suspended from the ends of the strap 22 such that the central axis of the bottle 24 is maintained substantially vertical.

In yet other embodiments, the slots 62 can have different geometries from that which is shown. For example, a bottle carrying device in accordance with the present invention can be used with a line or cord in place of a strap 22. If a line or cord is used, the slots 62 are preferably replaced with circular apertures to correspond to the circular cross-section of the line/cord. The slots 62 could also be replaced with apertures having other geometries, such as elliptical, oval, triangular, or square shapes, by way of non-limiting illustrative examples.

While preferred embodiments of the invention has been illustrated and described, it will be appreciated that various changes can be made therein without departing from the spirit and scope of the invention.

The embodiments of the invention in which an exclusive property or privilege is claimed are defined as follows:

1. A bottle carrying device for carrying a conventional bottle from a flexible extension member, wherein the bottle includes an externally threaded end, the device comprising:

(a) a main body portion including a first end and a second end, the first end having a substantially cylindrical recess formed therein, the recess including internal threads adapted to threadably receive the externally threaded end of the bottle, the second end having a passage formed therein, the passage connected in fluid communication with the recess;

(b) a spout connected to the second end of the main body portion, and connected in fluid communication with the passage, the spout including a cap slidable from a first position, to a second position, a path of fluid communication being open through the spout when the cap is in the first position, and the path of fluid communication through the spout being closed when the cap is in the second position; and (c) at least one wing connected to the main body portion, the wing having an aperture formed therethrough for receiving the flexible extension member, the at least one wing includes a channel formed therein, the channel extending from the aperture in the at least one wing to the exterior of the at least one wing, wherein the flexible extension member is slidable through the channel to the aperture.

2. The bottle carrying device of claim 1, wherein the main body portion comprising two wings, each of the wings extending generally radially from the main body portion substantially opposite each other.

3. The bottle carrying device of claim 2, wherein each channel extends at a diagonal angle from the exterior of the wing into each aperture, relative to a central axis of the bottle, when the main body portion is threadably connected to the threaded end of the bottle.

4. The bottle carrying device of claim 1, wherein the aperture in the at least one wing is generally in the shape of a slot for receiving the flexible extension member wherein the flexible extension member is in the form of a strap.

5. The bottle carrying device of claim 4, wherein the sides of the slot are oriented generally parallel to the longitudinal axis of a bottle when the main body portion is threadably connected to the threaded end of the bottle.

* * * * *